United States Patent [19]

Patrick et al.

[11] 4,309,066

[45] Jan. 5, 1982

[54] METHOD AND APPARATUS TO FABRICATE IMAGE INTENSIFIER TUBES

[75] Inventors: E. Vincent Patrick, Lorton; Howard K. Dickson, Alexandria; Howard L. Dunmire, Stafford, all of Va.

[73] Assignee: The United States of America as represented by the Secretary of the Army, Washington, D.C.

[21] Appl. No.: 113,156

[22] Filed: Jan. 18, 1980

Related U.S. Application Data

[63] Continuation of Ser. No. 93:0,264, Aug. 2, 1978, abandoned.

[51] Int. Cl.[3] ..... H01J 9/18; H01J 9/46

[52] U.S. Cl. ..... 316/19

[58] Field of Search ..... 316/19; 29/705

[56] References Cited

U.S. PATENT DOCUMENTS

| | | | |
|---|---|---|---|
| 3,853,374 | 12/1974 | Flasche et al. | 316/19 |
| 3,930,307 | 1/1976 | Schotthoefer et al. | 29/705 |
| 4,094,563 | 6/1978 | Simms | 316/19 |

*Primary Examiner*—Eugene F. Desmond

*Attorney, Agent, or Firm*—Nathan Edelberg; Milton W. Lee; John E. Holford

[57] ABSTRACT

A two chamber vacuum method and apparatus is provided for simultaneously and independently preparing image tube components, or the like, with two distinct vacuum environments for separate preparation of the components, and for final assembling of these components in an interconnecting compartment by vacuum sealing.

3 Claims, 6 Drawing Figures

METHOD AND APPARATUS TO FABRICATE IMAGE INTENSIFIER TUBES

The invention described herein may be manufactured, used, and licensed by the U.S. Government for governmental purposes without the payment of any royalties thereon.

This is a continuation of application Ser. No. 930,264, filed Aug. 2, 1978, now abandoned.

BACKGROUND OF THE INVENTION

The image intensifier has evolved rapidly from a simple diode to cascaded diodes, then to three elment tubes with microchannel plate electron multipliers, and now to microchannel plate tubes with extremely sensitive III-V compound photocathodes. However, the vacuum hardware used for processing and assembly of the components into finished tubes has processed much more slowly. The present lack of sophistication in vacuum hardware is an impediment to both tube research and high volume production. A typical processing system is still configured to accept one set of components. These components are loaded into the system at atmospheric pressure. To begin processing, the system must be evacuated and undergo a high temperature bakeout to achieve an adequate vacuum. Thus, with this first design limitation, the fabrication cycle is limited to the three parts initially loaded: there is no opportunity to replace a component if any part should fail. Secondly, single assembly requires a complete pump down and bakeout, normally a 12 to 18 hour procedure. And finally, all parts must be cycled through a terminal bakeout whose primary function is degassing of the vaccum chamber.

A second present deficiency is the near total lack of any test capability for component monitoring during the fabrication process. Each part undergoes at least three different process steps before the tube is finished. There is only limited means to determine the success or failure of any step during processing. Conventionally, components are tested only before loading and after completion of the tube. Because of the many processing steps and the multiple components, determination of process control by evaluation of only the finished tube is difficult, if not impossible. Only after the fabrication of many tubes can conclusions be unambiguously drawn.

The third deficiency is inadequate separation of process steps. Many compromises must be made in the conventional chamber because of the proximity of the parts during the processing of any one of them. One example is that all parts are thermally degassed at the same temperature, namely that used to degas the chamber. A second example is that the formation of the photocathode causes vapor pressures which affect the performance of the other parts. Many other examples of processing compromises are known to those familiar with the art.

Besides impeding image intensifier development, the conventional chamber design constitutes a high cost of both development and production. Already discussed are the long cycling time for a single fabrication, the inability to substitute parts when there are failures, and the difficulty in optimizing process control. To offset these deficiencies, many duplicate vacuum chambers are used. At best, one chamber can handle one test intensifier or one production assembly perday. So to progress at a reasonable rate, an extremely large number of individual vacuum stations is required.

BRIEF DESCRIPTION OF INVENTION

To address these deficiencies a new apparatus and method is hereby provided for the development and production of image tubes. This apparatus has, in the present invention, been configured for development of a new image tube configuration described in patent application Ser. No. 890,899 and 890,900 to Charles F. Freeman et al and E. Vincent Patrick et al, filed Mar. 28, 1978 and assigned to the same assignee as the present case, but is applicable to a wide range of vacuum manufacturing problems.

The method and apparatus involves a new two chamber system for processing vacuum products, such as image intensifiers, wherein all components are loaded into the previously evacuated chambers via separate vacuum interlocks. Any or all components may be replaced during processing; all components may be processed individually and separately; complete test capability is provided within the chamber for monitoring components throughout processing; two distinct vacuum environments are available to permit parallel but separate performance of incompatible process steps such as photocathode and microchannel plate processing; the final assembly is performed in an interconnecting region between the two chambers; and the finished product is removed via one vacuum interlock. New ports may be entered for on each short cycle of an interlock for an uninterrupted fabrication cycle.

BRIEF DESCRIPTION OF THE DRAWINGS

The invention is best understood with reference to the drawings, wherein.

DESCRIPTION OF THE INVENTION

Figure 1:
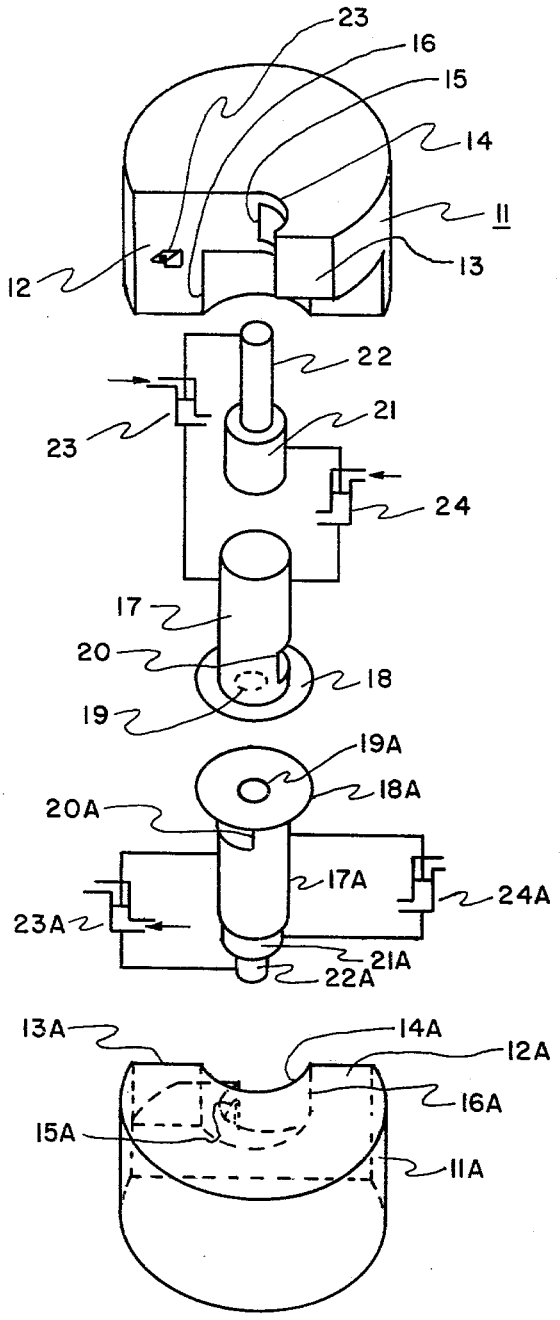
FIG. 1 shows a thin wall sketch of the two chamber vacuum system with a common vacuum lock and tube press.

Referring specifically to FIG. 1 there is shown a thin wall sketch of the two chamber vacuum system which shows the general shape and mating technique employed. The chambers 11 and 11A are basically cylindrical with a first flat face 12 parallel to the cylindrical chamber axis for mating purposes. The upper right hand quarter of the cylindder, however, as defined by planes normal to face 12 and normal or parallel to the cylindrical axis, respectively, projects beyond this face and terminates in a second flat face 13 parallel to the first. A third curved face 14 extending between the first and second is defined by a portion of the outer surface of a vacuum lock cylinder outside the chamber tangent to the first face with its axis parallel to the chamber axis and having a diameter somewhat larger than the distance between faces 12 and 13. The curved face contains a portal 15 which preferably extends nearly to the edges of the face leaving a border corresponding in width to the wall thickness of the vacuum chamber (about an inch). The overall chamber size may, for example, be based on a cylinder three feet in diameter and one foot high. The lower half of the chamber has an indent 16 defined by a cylinder coaxial with the lock cylinder, but of greater diameter, examples of the two being 8 and 6 inches, respectively. The lock cylinder 17 is hollow and open ended with a wall thickness about half that of the vacuum chamber. The axial length is somewhat greater than the thickness of the vacuum chamber at its maximum. The cylindrical disk shaped or annular inner lock flange 18, having a wall thickness the same as that of the vacuum chamber, is welded or otherwise secured in a vacuum tight fashion coaxially to one of the flat ends of the latter. The lock flange may constitute the chamber wall at the top of the indent 16 and may also be given an extended shape to also provide the lower wall of the chamber projection between walls 12 and 13. The flange has a coaxial cylindrical aperture smaller than the inside diameter of the lock cylinder so that there are inwardly and outwardly projecting flange portions extending radially an inch or more beyond the curved lock cylinder wall. The lock cylinder and flange contain a portal 20 which coincides with portal 15 in the chamber when nested with indent 16 and face 14, with the flange at the top of the indent. The lock cylinder, flange and chamber are welded together to provide a vacuum tight seal around the edge of the portals, the edge of the flange, and the edge of the lock cylinder touching the flange. A cup-shaped lock gate member 21 is slideable mounted in the lock cylinder. The gate has a special lower edge structure which vacuum seals to the flange 18 and a gate bellows attached between itself and the lock cylinder above the window 20, both of which will be described in greater detail at FIG. 3. A ram member 22, having a lower end portion (not shown) small enough to pass through the aperture 19, is slideably mounted through an opening in the top of the cup and this also has a ram bellows mounted between itself and the cup member 21 which will be described in more detail at FIG. 3. Thus these members can be coupled out of the top of the lock cylinder through suitable drive units 23 and 24, which when activated urge them toward the inner flange member 18. The second chamber 11A may have substantially identical features and lock members as indicated by the letter "A" after each number. When the flanges 18 and 18A are abutted, and vacuum sealed, the walls 12, 12A, 13 and 13A will be in close proximity to one another. L-shaped brackets 25 can be affixed to these walls on the outer walls of the chambers and bolted together. This will offset the pressure tended to separate the lock cylinders, when the ram members are driven together through the openings 19 and 19A to provide a press. The ends of the ram members near openings 19 and 19A are shaped to conform to the shape of an image intensifier tube or the like to seal together the products produced in the two vacuum chambers. The use of two lock gates 21 and 21A permits more efficient separation of the two vacuum chamber environments during processing of components in the two chambers, but excellent results are obtained even when one gate is omitted.

Figure 2:
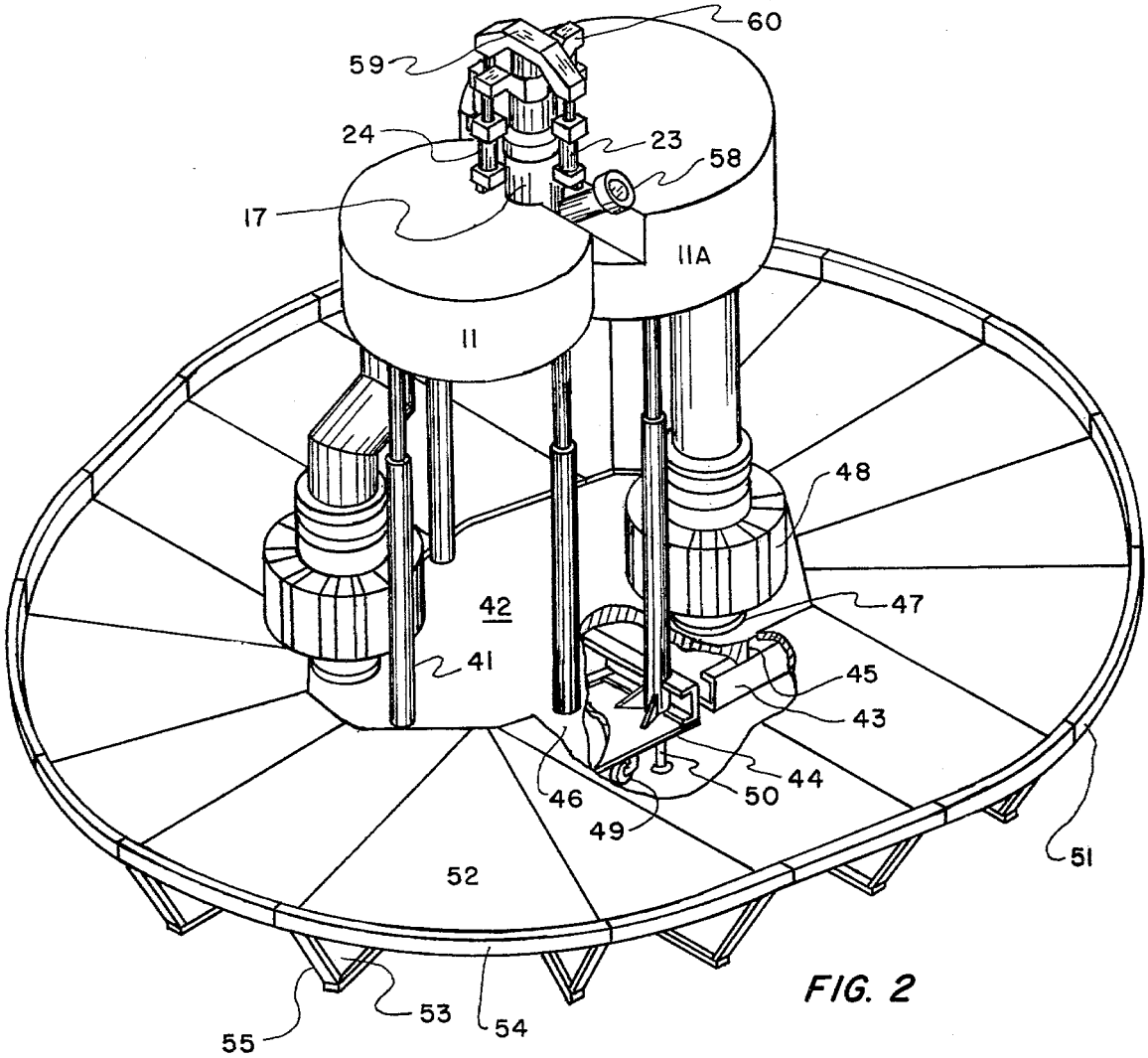
FIG. 2 shows a mounting arrangement for the vacuum chambers.
Figure 3:
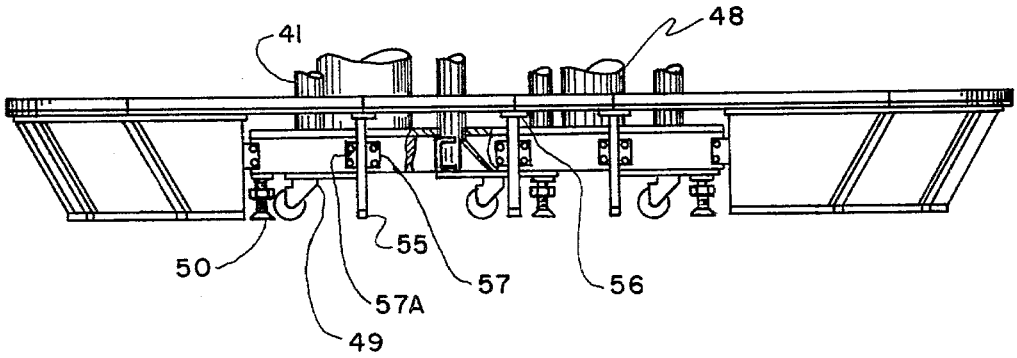
FIG. 3 shows an edge view of the base support in FIG. 3.

FIG. 2 and FIG. 3 shows a mounting arrangement for the vacuum chamber of FIG. 1. The chambers 11 and 11A are each mounted on a separate set of three legs 41. The chamber rests on pads atop each leg. Each pad has adjustment screws (not shown) which move each pad with three degrees of translation freedom for the alignment of all axes of each chamber.

The legs are firmly attached to a base support 42. The configuration of the base support is shown in the cutaway sections of FIGS. 2 and 3. Heavy steel channels 43 are welded to form a rigid framework. The legs are welded to appropriately located cross channel members 44 of this framework. The top of the framework is covered with a rigid thermal insulating board 45 to form a work surface above the framework and to provide an insulating bottom wall for use with a large portable vacuum bakeout oven (not shown) which otherwise encloses the entire system only during initial pump down. The base support is finished by a stainless steel skin 46 over the top of the board and the sides of the framework. Apertures like 47 in the base support are fitted with support collars to mount vacuum pumping equipment 48. The base support is fitted with both casters 49 and extendible stationary pads 50 at each corner and at two intermediate positions. The stationary pads are threaded so that the base support casters can be lifted off the floor, the chambers leveled, and the entire structure sits rigidly in place. The base support has approriate clearance from the floor to provide access beneath the framework to the vacuum pumps for power cables, water lines and maintenance.

A removable catwalk 51 in FIG. 2 surrounds the entire system and is positioned (after removal of the large portable bakeout oven mentioned above) above the surface of the base support by approximately one inch. All interconnections between the chambers and other equipment remote from the system run beneath the catwalk (e.g. pneumatic lines, power cables, signal cables, water lines, etc.) and extend up the legs to the chamber. By this means, auxiliary equipment can be located at the outer periphery of the catwalk, for ready access, while the operator also has completely unrestricted access to all sides of the chambers. Relative to the catwalk, the chambers are approximately waist high for accessibility of both top and bottom surfaces of the chambers. The catwalk is constructed of aluminum plates: floor plates like plate 52, and leg plates such as leg 53. Stiffening borders 54 and 55 are provided on both floor and leg plates. Each leg plate supports the edges of two adjacent floor plates and the floor plates are screwed to the top flanges 56 of the leg plate. By this means individual floor plate sections are readily removed for installation and maintenance of interconnecting cables and lines. The leg plates rest on the floor but are located relative to the chamber by L-shaped flanges 57 and bolts 57A threaded into the side channels of the base support.

Vacuum ports like port 58 of FIG. 2 are welded into the chamber wall wherever desired. On the curved surfaces of the chambers ports are mounted on tube stubs but on the flat surfaces vacuum flanges can be welded directly onto the flat plates of the chamber wall. The drive units 23 and 24 are coupled to the exterior of the lock cylinder and operate in pairs coupled to the yoke members 59 and 60 to smoothly propel the gate and ram members to which they are attached. Suitable drive units are, for example, Universal Model MPU3-7 pneumatic cylinders made by Scoville Fluid Power Corporation, Wake Forest, N.C.

Figure 4:
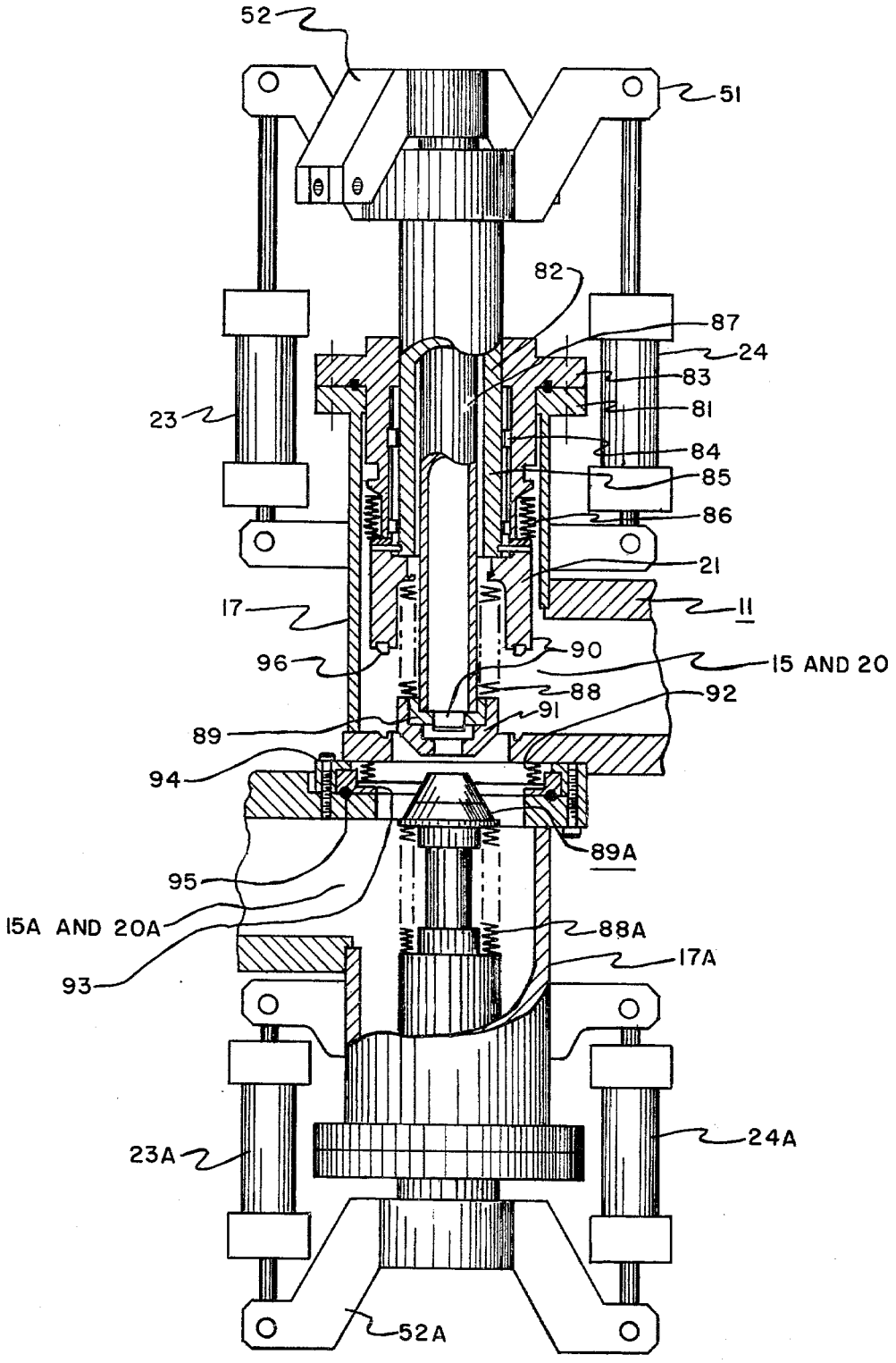
FIG. 4 shows the vacuum lock and tube press in greater detail.

FIG. 4 shows a cutaway view of the lock cylinder from FIGS. 1 and 2. This cylinder has an outer lock flange 81 welded on its open end. A guide tube 82 extends coaxially into this open end and has a guide flange 83 welded thereto which abuts and vacuum seals to the outer lock flange by means of a conventional knife edge groove and copper gasket. The inside of the guide tube is fitted with guide rings 84 which align an upper hollow tubular stem portion 85 of the lock gate 21. The lower end of the guide tube 82 is vacuum sealed to the upper edge of the gate member 21 by means of a first bellows 86. The ram member 22 also has a stem portion 87 which slides through and is coaxially aligned with the stem portion of the gate. Guide rings like rings 84 may be embedded in the inner surface of stem portion 85 for this purpose. The ram driver 89 of the ram is vacuum sealed at its upper end to the upper end of the gate by means of a second bellows 88. The ram stem is demountably attached to the ram driver by a bayonet socket arrangement. The ram driver incorporates a vacuum sealed window 90 for viewing the work through the hollow stem 87. A nose piece 91 is removably threaded or pinned to the ram driver 89 to adapt it to the workpiece to be manufactured. The stems are pinned to their respective yoke members and at their upper ends. The structure in and on lock cylinder 17A can be identical to that in cylinder 17 or the gate member 21 with its bellows 86, guide tube 82, and guide rings 84 can be omitted, the stemm 85 being welded directly to a flange like 83, but having a smaller opening therein to match the O.D. of the guide tube. The yoke on the guide tube would obviously be also omitted. The nose of the lower ram may be identical to the upper one or a different nose piece 91 may be provided. In some situation, it may be better to totally redesign the lower ram to perform cutting, shaping or other related operations. The ram shown in the present application are designed for a simple pressing operation on an image intensifier.

To facilitate the joining and aligning of the two chambers, one chamber is provided with a flanged bellows coupling. The bellows 92 is attached directly to the chamber by welding and in a similar manner to the coupling flange insert 93. Like all coupling flanges disclosed herein there is a groove in this flange and a knife edge to bite into a copper gasket 95 shared by the above groove and that in the mating flange. The above coupling flange collar 94, being a standard rotatable vacuum flange, is easily rotated (prior to sealing) into alignment with the mating flange to the other chamber. The holes in either flange are drilled through or blind tapped, depending on the accessibility of each bolthead at each angular location on the flange. The bellows is extended while the flanges are being bolted and then contracted as the chambers are aligned and bolted together. A copper gasket 96 is used on the bottom edge of gate 21. The gasket is a conventional vacuum washer and thus seals on a knife edge in the lock gate as well as on the sealing edge which engages the chamber wall. Other materials are readily used for this gasket, such as Vespel polyimide (DuPont). BunaN, the choice depending on the temperature cycles applied to the chamber.

The location of portals 15 and 20 from FIG. 1 are indicated in FIG. 4. With the ram and lock gate fully retracted (up) these portals are clear to receive components from the chamber. Components are placed between the two ram nose pieces 89 and 89A by a suitable carrier or manipulator. Components from the other chamber are similarly transferred through portal 15A and 20A below. The parts are either held in their carries during the pressing operation of the rams or placed in a suitable cradle integral with nose piece 89A. Each ram stem is driven by its own pair of drive units 97. Additionally, a high sealing force for absolute sealing of the valve (lock gate) with a metal or plastic gasket is obtained by coupling yokes 51 and 52 together by an auxiliary spacer collar between them and activating drive units 98 for the valve and those for yoke 52 (not shown) in parallel.

Figure 5:
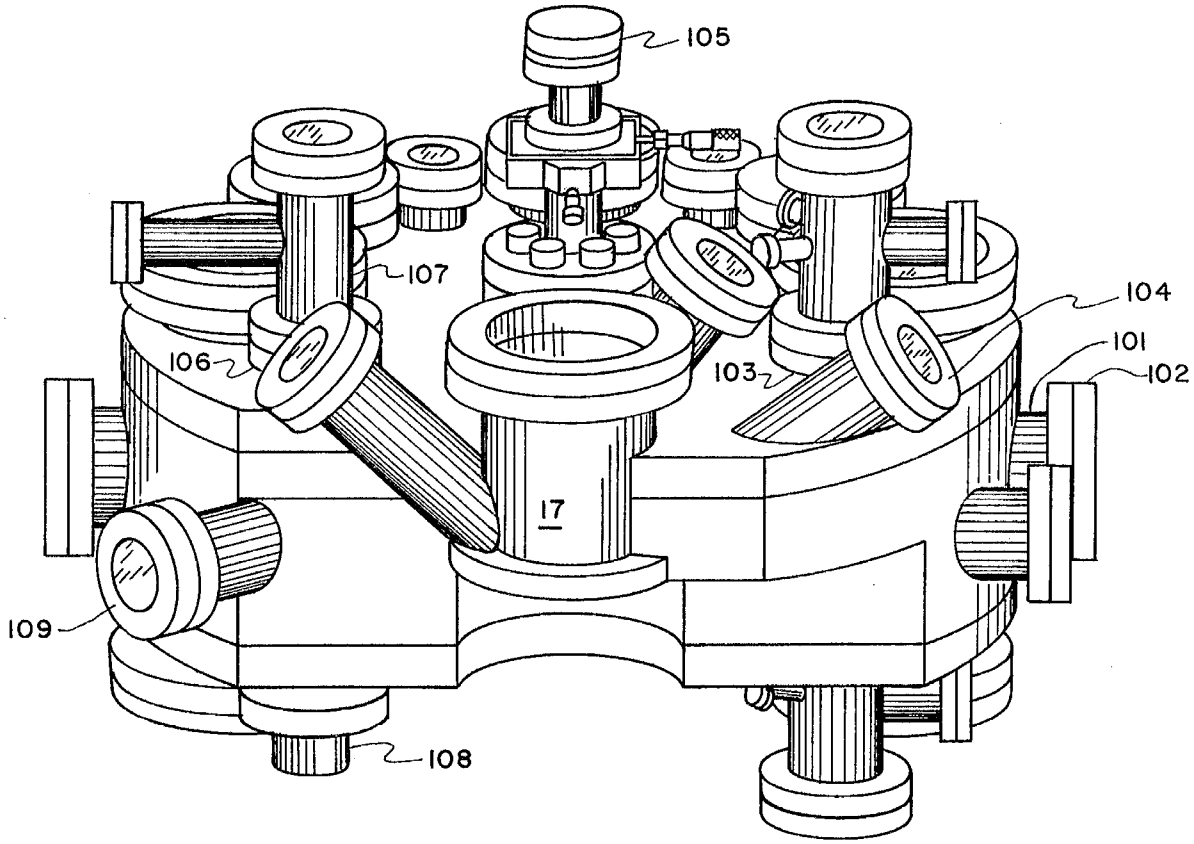
FIG. 5 shows one typical chamber in greater detail as viewed externally.

FIG. 5 shows a typical port arrangement used in each number. Wherever a port is needed the chamber wall is milled for welding of a vacuum flange. The curved surface of the chamber is generally fitted with tube stubs 101 and flanges 102. However, the flat surfaces are readily fitted with either stubs and flanges or flanges 103 welded directly to the surface. Exterior fillet welding around such flanges is advantageous for reinforcing the flat surface when a high density of ports are used, such as the number shown in this figure. A window cover 104 is bolted over the open end of each tube or flange. To utilize a specific port, the appropriate window cover is removed and replaced with a storing, processing or testing device such as an interlock or a manipulator 105. For the manufacture of microchannel plate image intensifiers, the manipulator disclosed in patent application Ser. No. 930,437 now U.S. Pat. No. 4,212,575, issued July 15, 1980 for a "Vacuum Sealed Manipulator" filed on even date and assigned to the same assignee as the present case herewith by Howard K. Dickson is preferred. One or two manipulators can be used per chamber. One can be fitted to the top center port and one of the bottom center port. The use of two manipulators is advantageous where multiple dissimilar parts are handled in a single chamber, such as a tube body and a phosphor faceplate. To introduce tube parts into the chamber without flooding the chamber a device as disclosed in patent application Ser. No. 930,265 now U.S. Pat. No. 4,212,317, issued July 15, 1980 for a "Vacuum Interlock" also filed on the same date as the present disclosure by E. Vincent Patrick and assigned to the same assignee as the present case, may be employed. A pair of flanges 106 and its opposite member coaxially positioned on the opposite exterior wall of the chamber receive the two halves of the interlock 107 and 108. The manipulator arm picks up image tube components inserted into the chamber via the interlock and carries them around the chamber in a circular clockwise path such that the part passes through the cylindrical axis at each of the remaining ports of the chamber as shown in the figure. The final position in the path of the part is the lock cylinder 17. The function of the lock cylinder for parts inserted through the lock cylinder portals was described above. The remaining ports of the chamber are fitted with the appropriate processing and test hardware. In general, there are three ports at each work position of the chamber to provide mechanical, electrical, and visual interaction with a port in the chamber. An example of such a work portion triplet is the interlock with the vestibule and seal 107 mounted above the valve driver 108 below, and a viewport 109 at the side of the chamber. Ports at other angles can be added, especially on the side walls, to provide more than three interactions at one work position. By virtue of the support structure described above, there is complete access to all parts of the triplet. The chamber shell itself is, in general, fitted with no integral devices for interaction with the image tube components within. All manufacturing and test functions are performed by flange mounted hardware fitted to the chamber flanges. By this means, maintenance and revision is performed with no alteration of the chamber and with minimal interruption of function.

Figure 6:
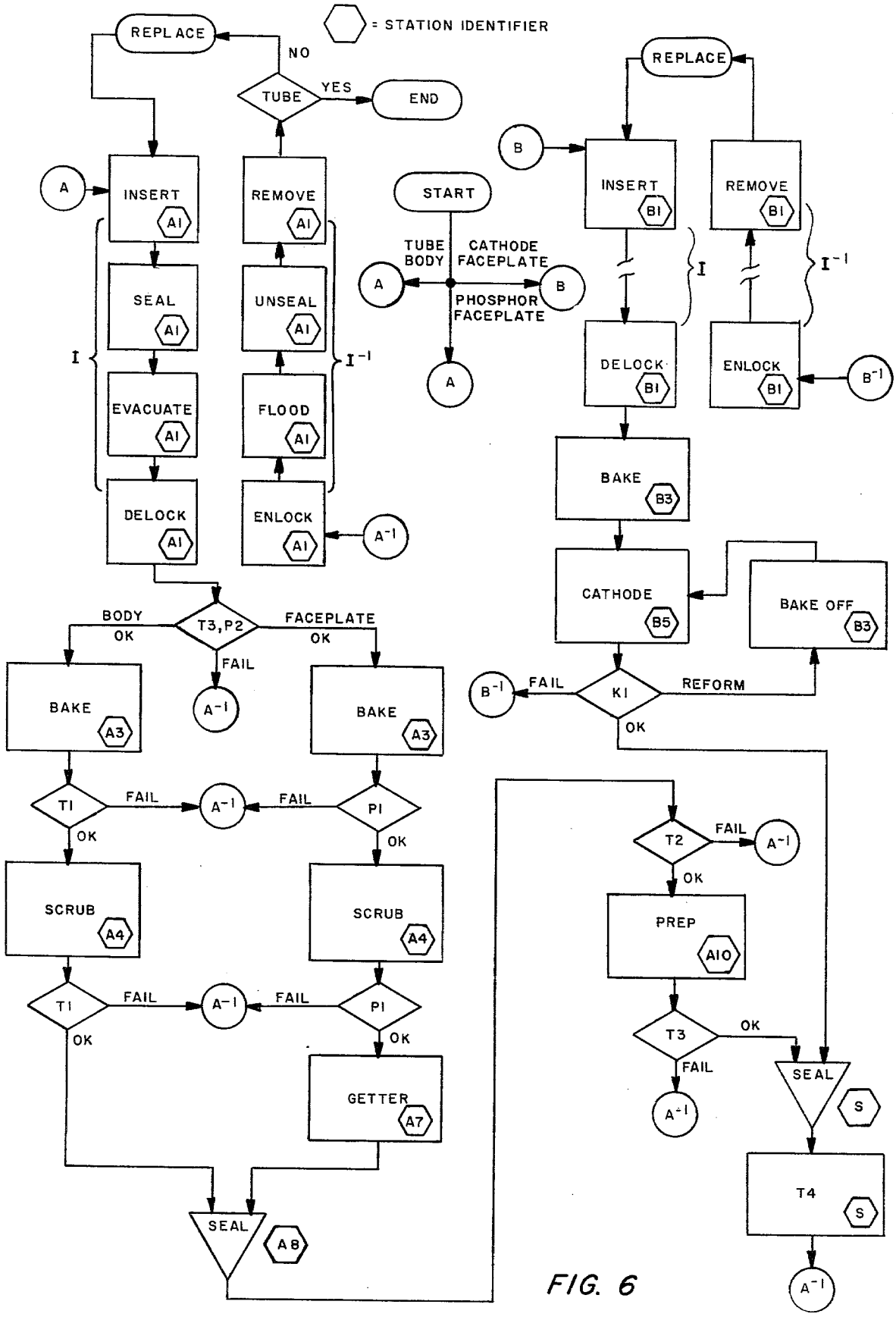
FIG. 6 shows a flow chart of a process for making image intensifiers in the above apparatus.

FIG. 6 shows a flow chart for the application of the chambers in a continuous, single tube manufacture. This sequence provides maximum process control, but minimum chamber throughput. However, even this minimum throughput far exceeds the throughput capacity of prior art hardware.

After the START, the flow chart divides into two subprocesses. Subprocess A is that conducted in one of the two chambers of the system (e.g. 1/A of FIG. 2) and subprocess B conducted in the other. The components to be processed and assembled are shown in patent application Ser. No. 890,899 for a "Microchemical Plate in Wall Structure" filed by E. Vincent Patrick et al, on Mar. 28, 1978, mentioned previously. Tube body and phosphor processing are performed in the A chamber; photocathode processing is performed in the B chamber. As discussed above, the vacuums of the two chambers are distinct, the chambers being separated by the vacuum valve in the lock cylinder 17 of FIG. 1. Subprocesses A and B process in parallel. The hexagonal "station indentifiers" of FIG. 6 identify the chamber by the letter A or B; a numerical suffix identified the sequential work position in the chamber. Station identifier S refers to work position formed by the coupled pair of lock cylinders from the two chambers. By virtue of the distinct vacuums, all incompatibilities between photocathode processing and other component processing are resolved. The vacuums remain distinct throughout the parallel subprocesses A and B until just before sealing of the photocathode to the finished tube at which time the valve between chambers is opened and the components are inserted into the lock cylinder for final tests and sealing.

Station A1 is a vacuum interlock through which the tube body and phosphor are simultaneously inserted into chamber A. Similarly the photocathode enters chamber B through a second vacuum interlock at station B1. The "insert" sequence for the interlock is labeled I, the "remove" sequence labeled I—I. The identical sequences are shown in truncated form for chamber B. Parts entering chamber A undergo initial tests to qualify them as suitable for processing and to determine the degree of processing necessary to prepare them for assembly. As can be seen for any test in the flow chart, shown as a decision symbol, a part that fails is immediately removed through the interlock (connector symbol A-1 and B-1) and replaced. Such testing is performed after every major process step, thus avoiding the expense and time of processing with inadequate parts and wasting good parts on inadequate assemblies. The specific process steps, which include depositing a coating on one of the subassemblies and tests will not be described but will be obvious to those familiar with image intensifier construction. The test prefixes, T, P, and K refer to tube, phosphor, and photocathode tests respectively; the numeral suffixes refer to sets of tests appropriate to the item and stage of processing. A list of typical tests is provided in Table I. Note that in general a different work position can be used for different processes and a set of tests may involve tests at several different work positions. Note also that as an alternative after test K1 of the cathode assembly there is an option to reform the cathode utilizing a "bake off" at work station B3. The tube body and phosphor are first finally assembled by sealing at station A8. This assembly is then sealed to the photocathode at Station S, the lock cylinder. The finished assembly is removed from the chamber through one of the interlocks.

The method of manufacture with this apparatus is continuous. New parts for the next assembly are loaded into the interlock and made ready for delock before the completion of the previous assembly. The new parts are entered into the chambers at the time the previous assembly is removed. This processing is continuous: no time is lost for either a new start or for a replacement part. This is possible by virtue of the interlock and manipulator disclosed. The manipulator is capable of picking up and depositing parts at any work position. The interlock inserts the parts for ready pickup by the manipulator with no disruption of ongoing processing.

This leads to the following generalizations of the method and apparatus. Any number of interlocks can be added to the chamber as required for the necessary amount of throughput. Part size is limited only by flange and valve size and driver stroke. Increased interlock size permits more parts per interlock-delock; more interlocks reduces interlock pump down time.

The rate of processing may be increased by a redundancy of hardware as required at work positions. The maximum rate is limited only by the chamber size employed and the compatibility of steps in each chamber for simultaneous processing. Batch processing is further facilitated by use of one or more part part storage carousel at work positions. Such a carousel can be used for storing new parts, semi-finished parts, parts awaiting assembly, or for vacuum aging of parts.

The lock cylinder and its internal parts are described above as used in "cold press" sealing of vacuum tubes using ductile metal seals. The design incorporates optical view ports for testing of intensifier assemblies before sealing and after sealing. However the lock cylinder is designed to accommodate all types of vacuum sealing techniques. The large diameter lock cylinder with multiple angular auxiliary ports as shown in FIG. 5 will readily accommodate hot solder seals, laser welding, thermal compression seals, electron beam welding, and ultrasonic bonding.

The application of the apparatus and method to other vacuum manufacturing problems will be obvious to those familiar with the arts. The apparatus is readily employed for processing of photomultiplier tubes, camera tubes, and the many styles of image intensifier tubes. The invention is, therefore, to be limited only as described in the claims which follow.

TABLE I

Typical Tests at Chamber Stations

Tests:

T1—Uniformity of microchannel output, maximum current gain, noise factor and outgassing (A4-6).

T2—All of T1 and voltage breakdown (A4-6).

T3—All of T2 and feedback (A4-6).

T4—Overall tube performance assembled, but unsealed (S).

P1—Total brightness, uniformity and outgassing (A4).

P2—Like P1, but outgassing omitted (A4).

K1—Maximum sensitivity and uniformity (B4).

KEY:

T—Body structure with microchannel plate.

P—Anode faceplate with phosphor screen.

K—Cathode faceplate with photocathode.

NOTE: Outgassing uses vacuum system mass spectrometer. Other tests require only readily available visual or electrical measuring equipment, such as photometers, voltmeters, anmeters, multichannel analyzers or the like.

We claim:

1. The method of fabricating a plurality of vacuum tubes in a continuously evacuated environment by means of a series of different steps, some of said different steps being performed simultaneously on different tubes; each tube having an anode and a cathode as subassemblies, the fabrication of said cathode in the presence of said anode adversely affecting the quality of said anode; comprising the steps of:

simultaneously sealing tools, parts and materials required to fabricate a plurality of said anode subassemblies in a first evacuated vacuum chamber;

simultaneously sealing tools, parts and materials required to fabricate a plurality of said cathode subassemblies in a second evacuated vacuum chamber having a wall portion in common with said first chamber, said wall portion containing a lock gate; fabricating said first and second subassemblies in said first and second sealed vacuum chambers, respectively;

serially testing each subassembly separately in said sealed chambers to locate defective parts;

serially replacing defective parts of each subassembly with new parts in said sealed chambers;

serially retesting said subassembly in said sealed chambers;

repeating the two previous steps when additional defective parts are found;

serially transporting said anode subassemblies through said lock gate to said cathode chamber containing said cathode subassemblies;

serially completing assembly of said tubes in said cathode chamber; and simultaneously removing a plurality of said completely assembled tubes from said cathode chamber.

2. The method according to claim 1 wherein said step of fabricating said first and second subassemblies further include the step of:

depositing a coating on one of said subassemblies.

3. The method according to claim 2 wherein said step of replacing defective parts includes the steps of:

baking off; and reforming said cathode.

* * * * *